United States Patent [19]

Chang

[11] Patent Number: 4,731,716

[45] Date of Patent: Mar. 15, 1988

[54] COLLAPSIBLE LAMP-SHADE STRUCTURE

[76] Inventor: Kuo-Hsiang Chang, 5th Floor, No. 4, Lane 281, Lung Chiang Road, Taipei, Taiwan

[21] Appl. No.: 8,761

[22] Filed: Jan. 30, 1987

[51] Int. Cl.[4] ..... F21V 1/06

[52] U.S. Cl. ..... 362/352; 362/358

[58] Field of Search ..... 362/450, 351, 355, 358, 362/352

[56] References Cited

U.S. PATENT DOCUMENTS

| | | | |
|---|---|---|---|
| 2,670,430 | 2/1954 | Leonard | 362/450 |
| 4,233,656 | 11/1980 | Shemitz | 362/352 |
| 4,354,222 | 10/1982 | Gall | 362/352 |

*Primary Examiner*—Larry I. Schwartz

*Attorney, Agent, or Firm*—Shoemaker and Mattare, Ltd.

[57] ABSTRACT

A lamp-shade structure for a decorative lamp having an inner and an outer lamp-shade. The inner lamp-shade includes an upper annular member, a lower annular member and a flexible material stretched therebetween, while the outer lamp-shade is composed of a number of frame members which are abutted one upon another at their sides to assume a polygonal shade around the inner lamp-shade. The upper and lower annular members are respectively provided with a plurality of loop-shaped lugs equidistantly located along their outer circumferences and extending away from their centers, and the frame members each have replaceably mounted thereon a decorative piece. A connecting element is detachably provided between each lug and each frame member thereby to form a dual lamp-shade construction.

6 Claims, 11 Drawing Figures

COLLAPSIBLE LAMP-SHADE STRUCTURE

FIELD OF THE INVENTION

This invention pertains to a lamp-shade structure, more particularly to a collapsible lamp-shade structure for a decorative lamp which can be easily assembled and disassembled by the user or customer.

BACKGROUND OF THE INVENTION

Most conventional lamp-shade structures for decorative lamps are so constructed that they can not be disassembled once their components are put together. Such constructions occupy a large space during transportation and transportation costs are thus increased. Although some recent lamp-shade structures can be disassembled as desired, disassembling is not easy and convenient because parts are generally fixed to each other by means of screws which always necessitate the use of hand tools for screwing in and screwing out. Furthermore, conventional lamp-shade structures for decorative lamps are generally all of a single lamp-shade type, designed so that the light passing through the lamp-shade will probably be so strong as to be unpleasant to one's eyes when one faces toward and looks at the lamp device.

Therefore, the main object of this invention is to provide a novel collapsible lamp-shade structure which is free of screws and is easily and conveniently assembled and disassembled by the user or customer.

Another object of this invention is to provide a collapsible lamp-shade structure which has a dual lamp-shade construction which softens the light passing through the lamp-shade before meeting one's eyes.

A further object of this invention is to provide a collapsible lamp-shade structure in which the outer lamp-shade has disposable decorative pieces which can be easily replaceable in order to renew the appearance of the lamp device as desired.

SUMMARY OF THE INVENTION

In accordance with the present invention there is provided a collapsible lamp-shade structure for a decorative lamp which has inner and outer lamp-shades. The inner lamp-shade includes an upper annular member, a lower annular member and a flexible material stretched therebetween, while the outer lamp-shade is composed of a number of rectangular frame members which are abutted one after another at their sides to assume a polygonal shade around the inner lamp-shade. The upper and lower annular members are respectively provided with a plurality of loop-shaped lugs equidistantly located at their respective outer circumferences and extending away from their centers, and the frame members each have replaceably mounted thereon a decorative piece. A connecting element is detachably provided between each lug and each frame member thereby to form a dual lamp-shade construction.

More specifically, in one embodiment the connecting element includes an arcuate portion, a rod portion having one end fixedly connected to the midpoint of the outer rim of the arcuate portion and extending away from the center of curvature of the arcuate portion, and clamping portions each provided at the extreme ends of the arcuate portion and the other end of the rod portion. The clamping portions are each capable of engaging with the corresponding lug and frame member to firmly fix them together.

In another embodiment, the connecting element includes a rod-shaped member which has its one end provided with a clamping portion for engaging with the corresponding lug, and the other end formed with a recess hole for receiving a rod member fixedly connected to the midpoint of the top and bottom sides of the rectangular frame member.

To further fix the frame members together, clip members each having a pair of consecutive grooves are mounted on the left and right sides of a pair of frame members that are abutted to each other at their one side.

BRIEF DESCRIPTION OF THE DRAWINGS

These and other objects and advantages of the invention will become apparent from the following description taken together with the accompanying drawings, in which.

DETAILED DESCRIPTION OF THE PREFERRED EMBODIMENTS

Figure 1:
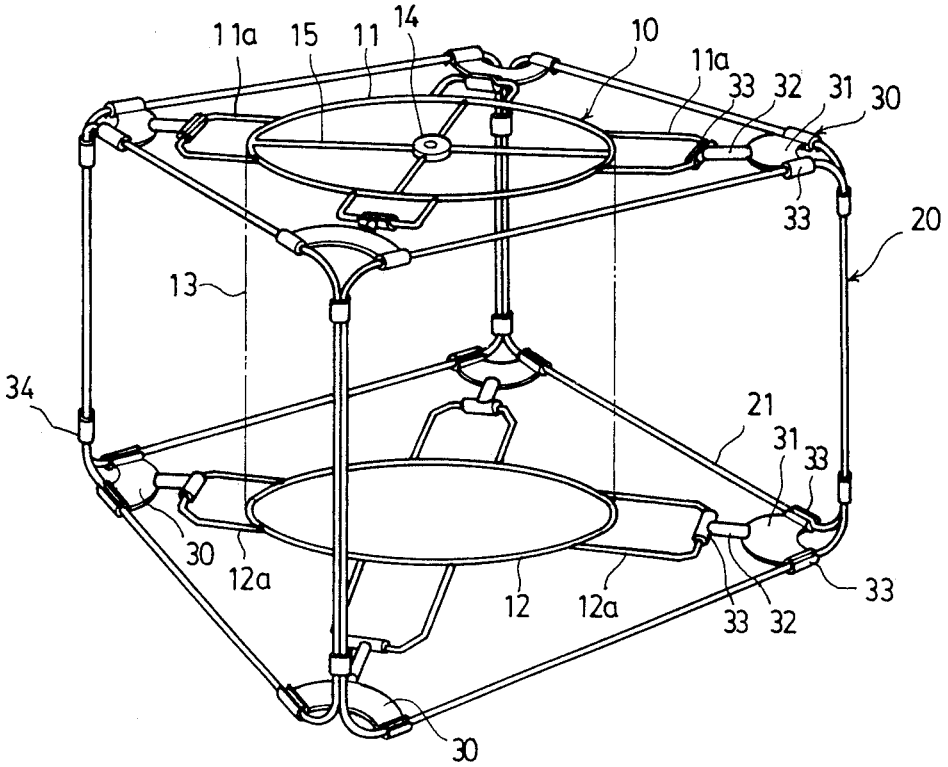
FIG. 1 is a perspective view showing a general arrangement of a first embodiment of the present invention.
Figure 2:
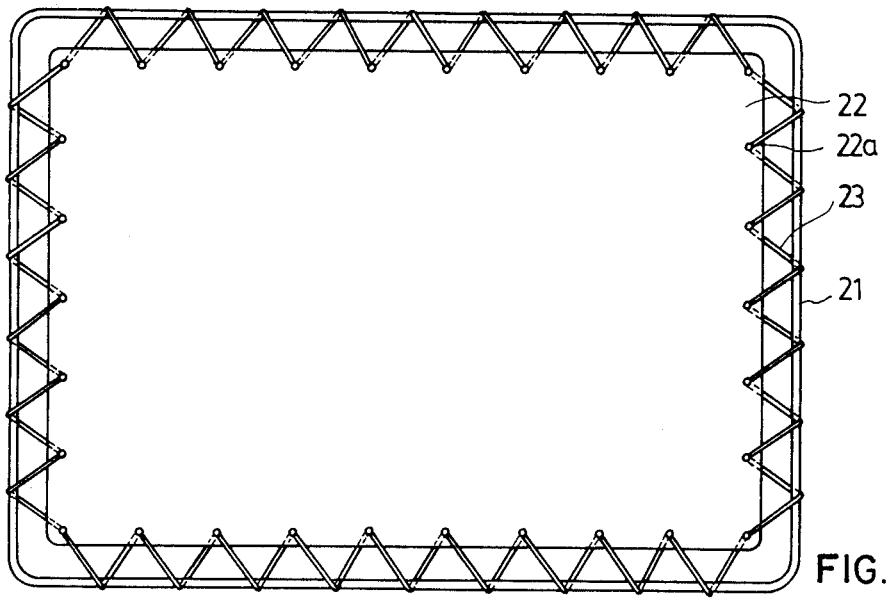
FIG. 2 is a plan view showing a connecting arrangement between the decorative piece and the frame member shown in FIG. 1.
Figure 3:
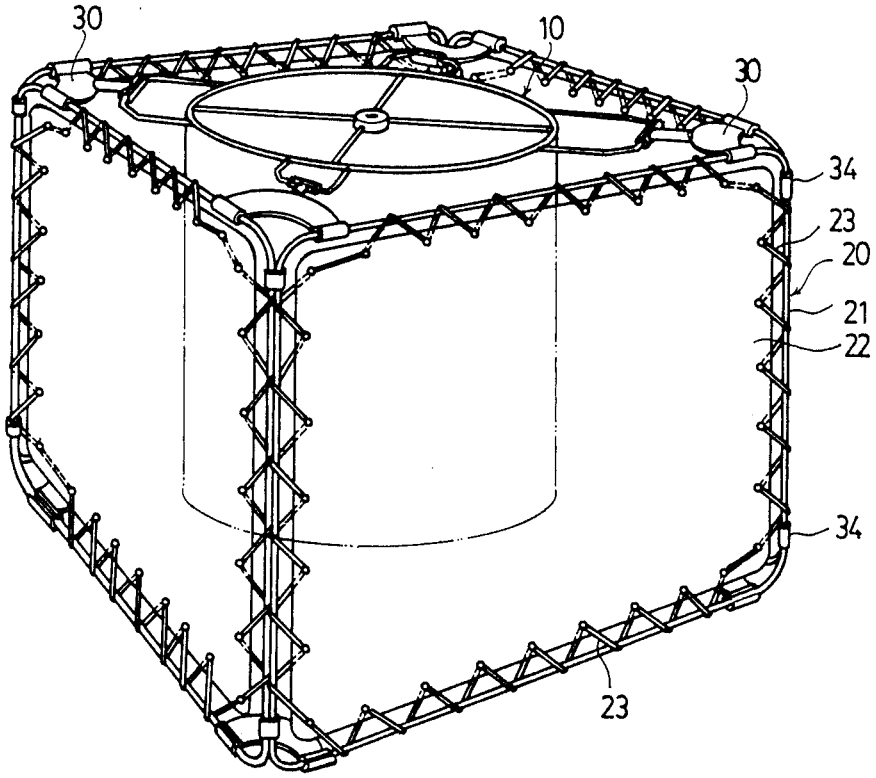
FIG. 3 is a perspective view similar to FIG. 1 showing a complete device according to a first embodiment of this invention.

Referring to FIGS. 1–3, there is shown a first embodiment of the present invention. Broadly stated, the composite lamp-shade structure according to the present invention is composed of an inner lamp-shade 10, an outer lamp-shade 20 having a plurality of frame members 21, each having attached thereon a decorative piece 22, and a plurality of connecting elements 30 provided between inner and outer lamp-shades 10 and 20.

Figure 1A:
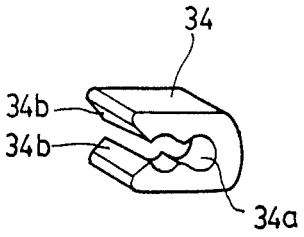
FIG. 1A is an enlarged perspective view of a clip member shown in FIG. 1.

More specifically, inner lamp-shade 10 has an upper annular member 11, a lower annular member 12 and a flexible shade cloth 13 stretched therebetween (as shown by the dotted line). At the center of upper annular member 11 a fixing member 14 is provided, which is fixedly connected to upper annular member 11 by means of link members 15 and can be used as a means for mounting the electrical bulb (not shown) of the lamp device. Loop-shaped lugs **11*a* and 12*a* are each equidistantly arranged around the outer circumference of upper and lower members 11 and 12 respectively. These lugs 11*a* and 12*a* each extend away from the center of respective annular members 11 and 12, as shown in FIG. 1. In this embodiment, outer lamp-shade 20 is composed of four frame members 21 preferably of a circular cross-section. Frame members 21 are formed in a rectangular shape such that they have four sides, i.e., the top, bottom, right and left sides. Further, each connecting element 30 is an integral member formed with an arcuate portion 31 and a rod portion 32 having one end connected to the midpoint of the outer rim of arcuate portion 31. At the extreme ends of arcuate portion 31 and the other end of rod portion 32 a clamping portion 33 is provided which is adapted to engage with corresponding lug 11***a* or 12*a* and the top or bottom side of frame member 21. Alternatively, connecting element 30 may be that which includes two separate components instead of an integral member described above. Namely, both of arcuate portion 31 and rod portion 32 are individually formed and they are connected with each other by means of engaging an extension (not shown) formed at one end of rod portion 31 which has clamping portion 33 at its other end into a recess hole (not shown) formed at the midpoint of the outer rim of arcuate portion 31. To further fix frame members 21 with each other, clip members 34 are provided. As clearly shown in FIG. 1A, each clip member 34 is integrally formed with a pair of consecutive grooves 34*a*, each being of a size matching with the diameter of one side of frame member 21. At its expandable end clip member 34 is provided with inclined surfaces 34*b* to facilitate connecting abutted sides of two frame members 21 which are adjacent to each other.

Figure 2A:
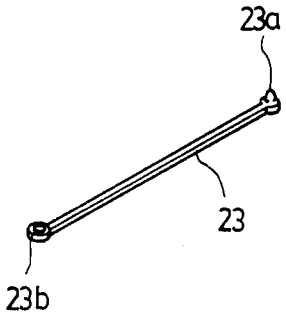
FIG. 2A is an enlarged perspective view of the engaging member shown in FIG. 2.

After inner and outer lamp-shades 10 and 20 are connected to each other as described above, on the front surface of each frame member 21 a rectangular decorative piece 22 is mounted. Decorative piece 22 is made of transparent material and is provided with a decorative pattern such as figures or a landscape on its surface, and a plurality of holes 22*a* equidistantly located along the portions near its four edges. Decorative piece 22 is replaceably mounted on frame member 21 with the aid of engaging members 23. As shown in FIG. 2A, engaging member 23 is a slender member having its opposite ends formed with an engaging projection 23*a* and a recess hole 23*b* respectively. Engaging projection 23*a* is so dimensioned that it is a little larger in diameter than the recess hole 23*b* to assure a firm engagement between them while allowing it to disengage from the latter if a proper disengagement force is applied. For assembly, first position decorative piece 22 within frame member 21 and place one engaging member 23 on decorative piece 22 with its engaging projection 23*a* aligned with and extended through hole 22*a* and its recess hole 23*b* located just beyond the boundary of frame member 21, then use another engaging member 23 to engage with the preceeding engaging member 23 from the rear with its engaging projection 23*a* engaged into the recess hole 23*b* of the preceeding member 23 and its recess hole 23*b* aligned with the hole adjacent to the hole which is already ocuupied by the preceeding engaging member 23. With engaging members 23 alternately engaged one after another in this way, decorative pieces 22 can be suitably and detachably mounted on frame member 21.

Figure 4:
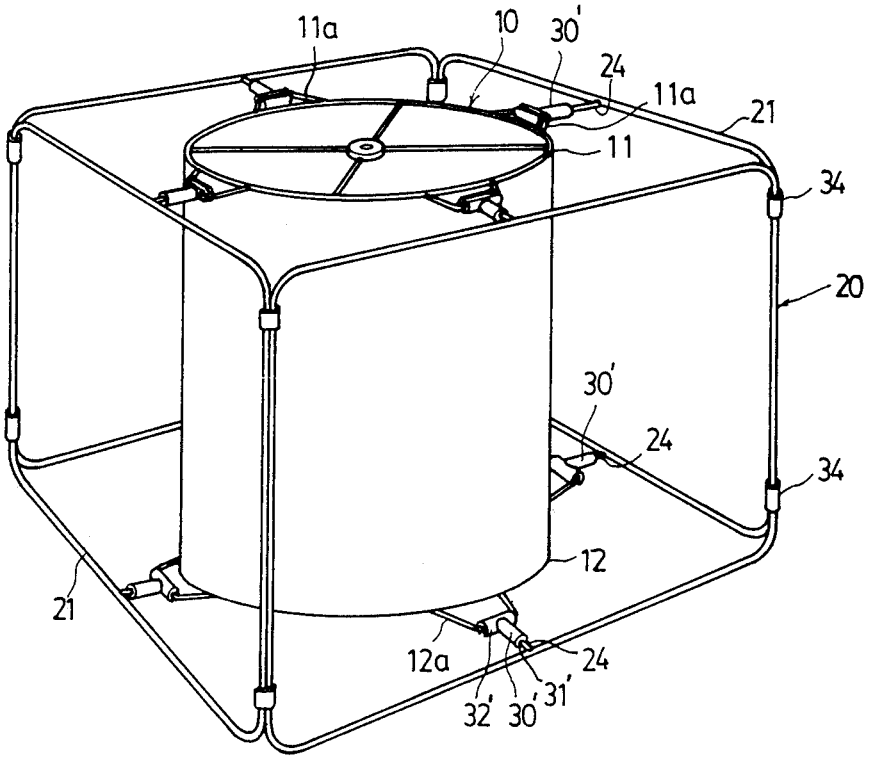
FIG. 4 is a perspective view showing a general arrangement of a second embodiment of the present invention.

A second embodiment in accordance with the present invention is shown in FIG. 4. It is to be noted that the difference between the second embodiment and that of FIG. 1 mainly resides in the configuration of the connecting elements, and thus the correspnding parts will be designated with the same reference numerals. In this embodiment, connecting element 30' is a rod member integrally formed at its one end with a recess hole 31' for receiving a rod 24 fixedly provided preferably at the midpoint of a top or bottom side of frame member 21, and a clamping portion 32' at its other end for clamping lug 11*a* or 12*a*. With connecting elements 30' mentioned above, inner lamp-shade 10 and outer lamp-shade 20 can be firmly fixed to each other, and then decorative pieces 22 may be attached to corresponding frame members 21 with engaging members 23 in the same way as mentioned above to complete a lamp device as shown in FIG. 4A.

Figure 4A:
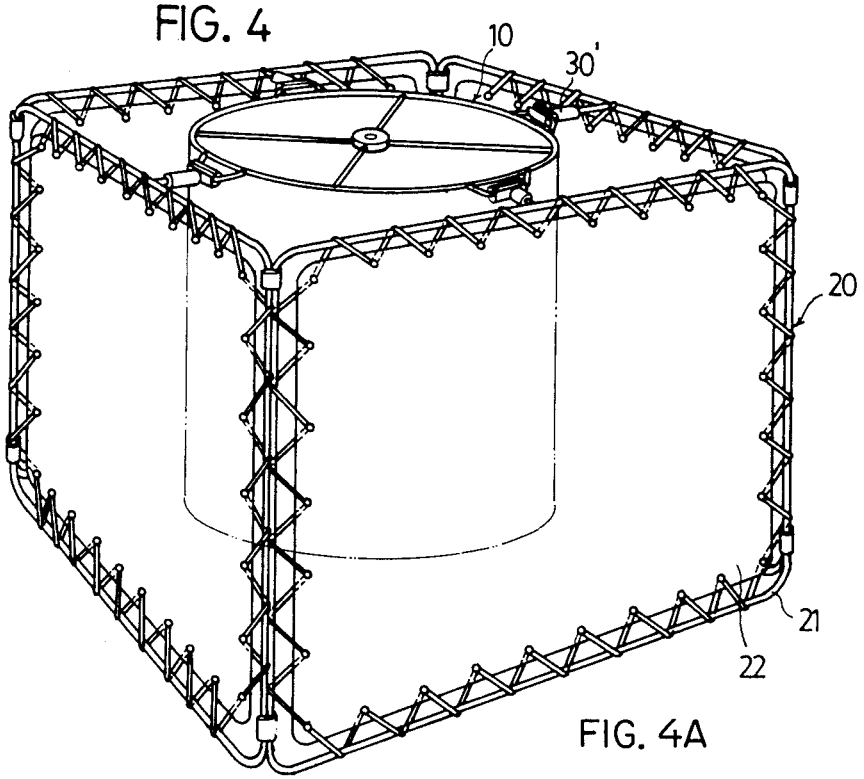
FIGS. 4A, 4B, 4C and 4D are perspective views similar to FIG. 4 showing various configurations of the outer lamp-shade according to this invention.
Figure 4B:
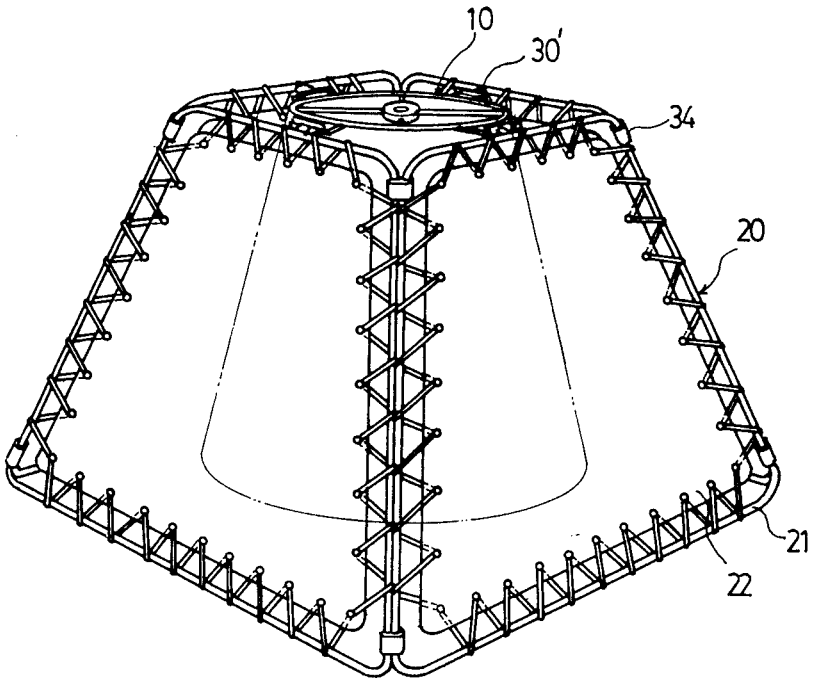
Figure 4C:
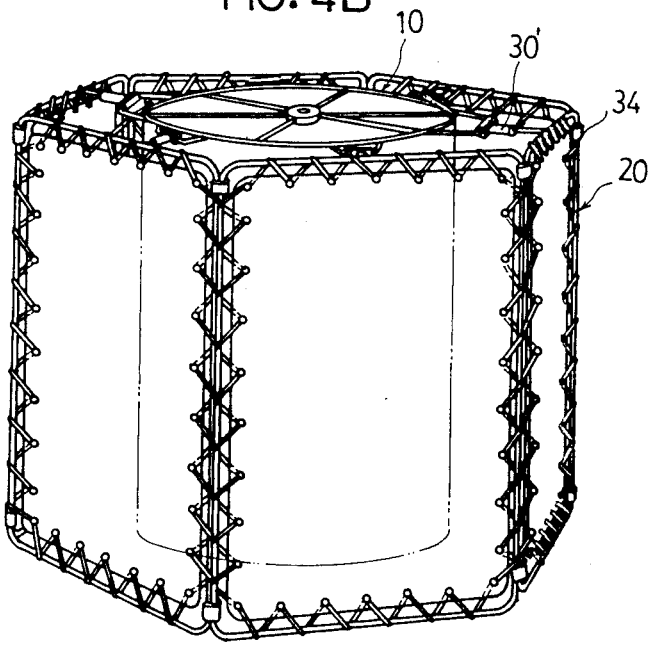
Figure 4D:
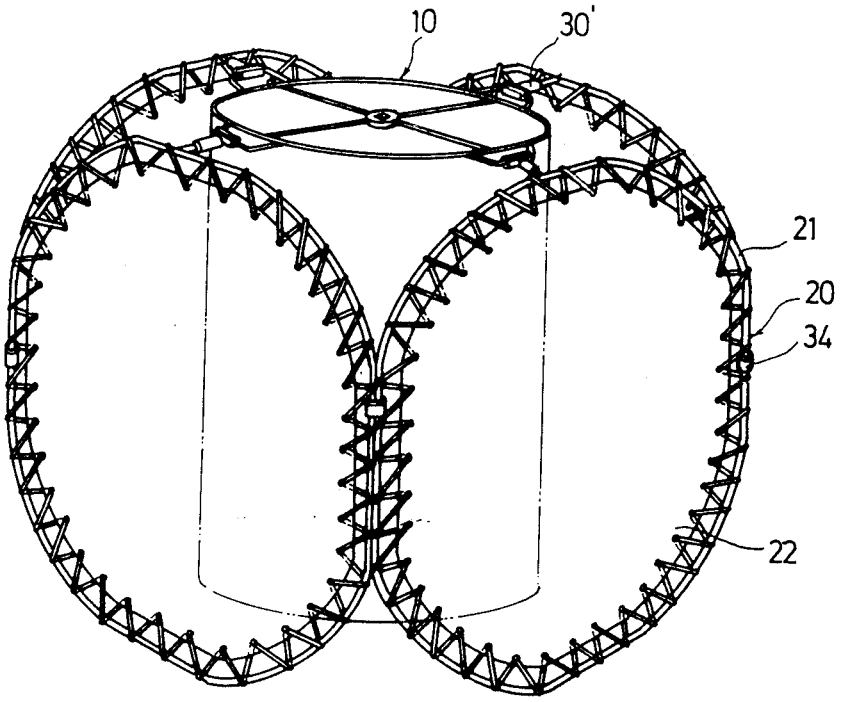
Figure 5:
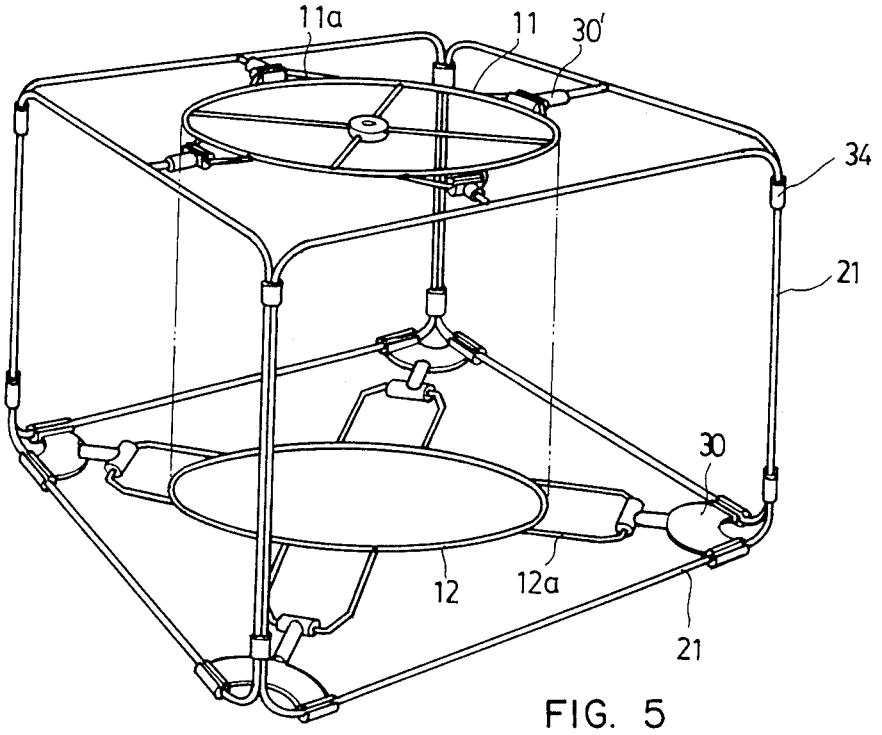
FIG. 5 is a perspective view showing a general arrangement of a third embodiment of the present invention.

Except for the configuration shown in FIGS. 3 and 4A, the outer lamp-shade 20 composed of frame members 21 and decorative pieces 22 may be constructed in any suitable polygonal shape as desired. For example, in FIG. 4B the outer lamp-shade 20 is taken in the shape of a truncated pyramid, while in FIG. 4C it assumes the shape of a hexahedron. From these figures it can to be seen that frame members 21 together with decorative pieces 22 mounted thereon may also have a suitable shape such as a rectangle, a trapezoid, or an oval, each of which is clearly shown in FIGS. 4A, 4B and 4D respectively. Also, it is readily understood that the connecting elements 30 and 30' shown in FIGS. 1 and 4 can be applied on the same collapsible lamp shade structure in accordance with the present invention, i.e., connecting elements 30' of FIG. 4 can be used to connect upper annular member 11 and the top sides of corresponding frame members 21 and connecting elements 30 of FIG. 1 can be used to connect lower annular member 12 and the bottom sides of frame members 21, or vise versa, which arrangement is clearly shown in FIG. 5 and constitutes a third embodiment of this invention.

From the foregoing, the composite lamp-shade structure has the following advantages as compared to conventional lamp-shade structures:

1. This lamp-shade structure is constructed in a collapsible manner, which greatly reduces the packing space needed during transportation, thereby lowering the transportation costs.

2. All the components are of knock-down parts and attached to each other by the engagement method and not by screws, which will facilitate assembly and disassembly, thus making it suitable for D.I.Y. fans.

3. This invention includes a dual lamp-shade construction which is helpful in making the light passing through the lamp-shades soft without greatly affecting the illumination of the lamp device.

4. The outer lamp-shade has decorative pieces so provided that the latter can be replaced as desired to improve or change the appearance of the whole lamp device.

I claim:

1. A collapsible lamp-shade structure, comprising:

an inner lamp-shade having an upper member, a lower member and a flexible cloth stretched therebetween to confine a space for the light source; said upper and lower members each being provided with a plurality of lugs each being spaced equidistantly around the outer periphery and extending away from the center of respective said upper and lower members;

an outer lamp-shade having a plurality of frame members each being located equidistantly away from said inner lamp-shade and abutted end-to-end with one after another to assume a polygonal shape, and a plurality of decorative pieces of transparent material, each being detachably provided on respective said frame member; each said frame member having top, bottom, left and right sides; and a plurality of connecting means provided between said lugs and top and bottom sides of said frame members for detachably connecting said inner and outer lamp-shades with each other.

2. A collapsible lamp-shade structure as recited in claim 1, wherein each said connecting means comprises a member having an arcuate portion, a rod portion having one end connected to the midpoint of the outer rim of said arcuate portion and extending away from the center of curvature of said arcuate portion, and clamping portions each being formed at the extreme ends of said arcuate portion and the other end of said rod portion and adapted to engage with corresponding said lugs and said top and bottom sides of said frame members.

3. A collapsible lamp-shade structure as recited in claim 1, wherein each said connecting means comprises an arcuate member and a rod member, said arcuate member being formed at its extreme ends with clamping portions adapted to engage with said top and bottom sides of said frame members, and said rod member being formed at one end with a clamping portion adapted to engage with corresponding said lugs and an extension at the other end adapted to engage into a recess hole formed at the midpoint of the outer rim of said arcuate member.

4. A collapsible lamp-shade structure as recited in claim 1, wherein each said connecting means comprises a member having a rod portion, a clamping portion formed at one end of said rod portion and adapted to engage with corresponding said lugs, and a recess hole formed at the other end of said rod portion and adapted to receive a rod member fixedly provided at the top and bottom sides of respective said frame members.

5. A collapsible lamp-shade structure as recited in any one of claims 1 to 4, further comprising a plurality of clip members adapted to engaged with a pair of left and right sides of a pair of adjacent said frame members that are abutted to each other with their respective right and left sides.

6. A collapsible lamp-shade structure as recited in any one of claims 1 to 4, wherein each said decorative piece comprises a plurality of holes provided along its edges and spaced equidistantly to each other, and a plurality of engaging members each having an engaging projection and a recess hole at its opposite ends; and said decorative piece is detachably mounted on said frame member by said engaging members to be engaged one after another with their engaging projections and recess holes extending between said holes of said decorative piece and the boundary of said frame member.

* * * * *